US009421549B2

(12) United States Patent
Morrison

(10) Patent No.: US 9,421,549 B2
(45) Date of Patent: Aug. 23, 2016

(54) MATERIAL TREATMENT AND APPARATUS

(75) Inventor: Michael Morrison, Launching Place (AU)

(73) Assignee: A NEW WAY OF LIVING PTY LTD (AU)

( * ) Notice: Subject to any disclaimer, the term of this patent is extended or adjusted under 35 U.S.C. 154(b) by 868 days.

(21) Appl. No.: 13/641,818

(22) PCT Filed: Apr. 27, 2011

(86) PCT No.: PCT/AU2011/000480

§ 371 (c)(1),
(2), (4) Date: Dec. 18, 2012

(87) PCT Pub. No.: WO2011/130805

PCT Pub. Date: Oct. 27, 2011

(65) Prior Publication Data

US 2013/0095321 A1 Apr. 18, 2013

(30) Foreign Application Priority Data

Apr. 22, 2010 (AU) ..... 2010901691

(51) Int. Cl.
*B02C 18/06* (2006.01)
*B02C 13/18* (2006.01)
*B02C 13/14* (2006.01)

(52) U.S. Cl.
CPC ..... *B02C 18/06* (2013.01); *B02C 13/18* (2013.01); *B02C 2013/145* (2013.01); *Y10T 428/2982* (2015.01)

(58) Field of Classification Search
CPC .. B02C 18/16; B02C 13/18; B02C 2013/145; B02C 17/166; B02C 18/06; B02C 17/16; B02C 13/282; B02C 13/26; B02C 13/28; B02C 17/18; B02C 17/22; B02C 19/00; B02C 2/10
USPC ..... 241/189.1, 257.1, 260, 301
See application file for complete search history.

(56) References Cited

U.S. PATENT DOCUMENTS 4,562,972 A * 1/1986 Hagiwara ..... B02C 2/10 241/162
5,269,471 A 12/1993 Yamagishi
5,620,147 A 4/1997 Newton
5,637,434 A * 6/1997 Ikushima ..... B02C 2/10 241/24.28
5,791,569 A 8/1998 Ishikawa
5,845,855 A * 12/1998 Yamada ..... B02C 2/10 241/260
6,630,277 B2 * 10/2003 Naka ..... B02C 2/10 241/24.18
2002/0182528 A1 12/2002 Nakanishi et al.

(Continued)

FOREIGN PATENT DOCUMENTS

DE 102011088709 A1 * 6/2013 ..... H02K 5/18
EP 0122608 10/1984

(Continued)

OTHER PUBLICATIONS

International Search Report for International Application No. PCT/AU2011/000480; Jul. 13, 2011; 3 pages.

*Primary Examiner* — Alexander P Taousakis
*Assistant Examiner* — Leonel Vasquez
(74) *Attorney, Agent, or Firm* — Perkins Coie LLP

(57) ABSTRACT

A method and apparatus for very fine grinding which uses a rotor rapidly rotating in a compatible cylindrical housing where there is an improvement of a friction inducing surface on the cylindrical face to assist in the grinding effectiveness.

6 Claims, 7 Drawing Sheets

(56) References Cited

U.S. PATENT DOCUMENTS

| | | | | |
|---|---|---|---|---|
| 2007/0084951 | A1* | 4/2007 | Ueno | B02C 2/10 241/65 |
| 2009/0206186 | A1* | 8/2009 | Morrison | B01D 21/06 241/24.16 |
| 2010/0230524 | A1* | 9/2010 | Ueno | B02C 2/10 241/244 |

FOREIGN PATENT DOCUMENTS

| | | | | |
|---|---|---|---|---|
| EP | 0 704 245 | A1 | 4/1996 | |
| EP | 0775526 | | 5/1997 | |
| GB | 939206 | A * | 10/1963 | B02C 13/18 |
| JP | 59-105853 | | 6/1984 | |
| JP | 09-201543 | | 8/1997 | |
| JP | 2004-042029 | | 2/2004 | |

* cited by examiner

--- PRIOR ART ---

MATERIAL TREATMENT AND APPARATUS

CROSS-REFERENCE TO RELATED APPLICATIONS

This application is a 35 USC §371 application of International Application No. PCT/AU2011/000480 filed Apr. 27, 2011, which claims priority to Australian Patent Application No. AU2010901691 filed Apr. 22, 2010, both of which are hereby incorporated by reference in their entirety.

This invention relates to material treatment method and also to an apparatus for effecting treatment of material.

BACKGROUND OF THE INVENTION

The problem to which this invention is directed relates to treatment of materials so that they can be efficiently broken down into very small sizes.

We have previously described an apparatus which included a rotating rotor within a cylindrical cavity to effect grinding of particles to small size.

This previous apparatus an example being described in Australian patent AU 2005204977 provided some diminution of particle size but in many cases was relatively inefficient and also did not enable reduction of particles as much as would be desired.

SUMMARY OF THE INVENTION

We have discovered that by making a relatively modest change to the apparatus and to the method, improved efficiency of treatment can be gained.

In one form of this invention it could be said to reside in a particle treatment method reducing particle size which includes the steps of introducing particles to be treated into an apparatus where there is a chamber with a substantially cylindrical portion and a rotating rotor coaxially positioned within the substantially cylindrical portion and defining between the two a co-annular cylindrical space, at least two blades equally spaced apart around the circumference of the rotor and each extending from the rotor and defining a separation gap between an inner wall of the substantially cylindrical portion and its outer edge, there being one or more vortex supporting and defining spaces between the respective blades, and at least some of the inner wall of the substantially cylindrical portion having a friction inducing surface.

In a further form the invention could be said to reside in an apparatus comprising a chamber with a cylindrical portion and a rotating rotor coaxially positioned within the cylindrical portion, at least two blades equally spaced apart around the circumference of the rotor and each extending from the rotor and defining a separation gap between an inner wall of the cylindrical portion and its outer edge, and there being one or more vortex supporting and defining spaces between the respective blades, and at least some of the inner wall of the cylindrical portion having a friction inducing surface, an inlet for particles to be treated in the chamber and an outlet for particles treated spaced apart from the inlet.

The invention can also be said to reside in materials treated by being introduced and dealt with by the apparatus.

The invention can also be said to reside in material having been reduced in particle size in accord with the said method herein.

Hitherto there has been a smooth inner wall on the cylindrical portion.

It has been discovered that by introducing a friction inducing surface the efficiency of the treatment size reduction process is significantly increased.

Such friction inducing surface can be at spaced apart locations around a periphery of the generally cylindrical chamber or in another instance it can be continuous around the said periphery.

One example of a friction inducing surface includes randomly shaped portions projecting into at least some of the vortex supporting and defining spaces.

A discovery associated with this method and apparatus is that its treatment of particles does appear to be associated with entering and being subject to energetic forces within a vortex.

Associated with such action is also the fact that a vortex includes portions of higher pressure and portions of lower pressure and that particles entering such a vortex will be subject to a low pressure environment which will induce drying.

Such a drying effect is not restricted necessarily to water and materials that have been introduced through the process have been found to have significant reduction in retained moisture.

It is assumed that the mechanism for this includes vacuum evaporation and perhaps recondensation but separated from particles and then caught up in the air flow which then carries the liquid vapours away separately from the solid particles.

Examples of the friction inducing surface include randomly deposited adhering particulate materials.

It has been observed that the incorporation of such friction inducing materials does not appear to act directly on particles treated through the machine except indirectly insofar that it seems to induce through relative engagement of the fluid medium through which the processes have their vortexes which are themselves then more consistently maintained and kept in a rotory mode by the relative movement of captured air between the blades and the friction inducing surfaces.

This has been indicated also by the fact that there is very little wear exhibited on experiments conducted thus far on any friction inducing surfaces.

DESCRIPTION OF THE DRAWINGS

For a better understanding of this invention it will now be described with reference to embodiments which shall be described with the assistance of drawings wherein.

DESCRIPTION OF EMBODIMENTS

Figure 1:
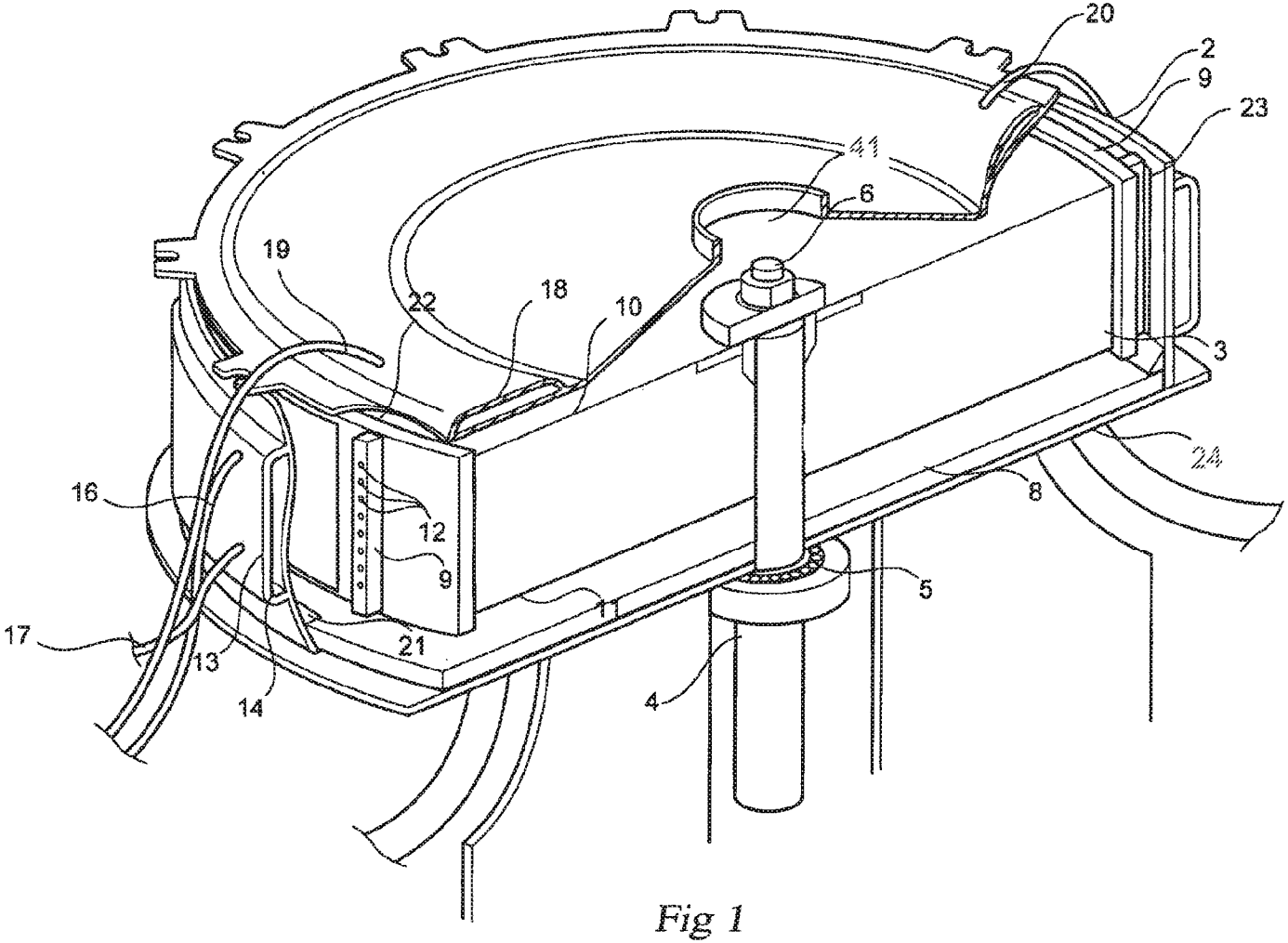
FIG. 1 is a perspective view partly cut away of an apparatus according to a first embodiment.
Figure 2:
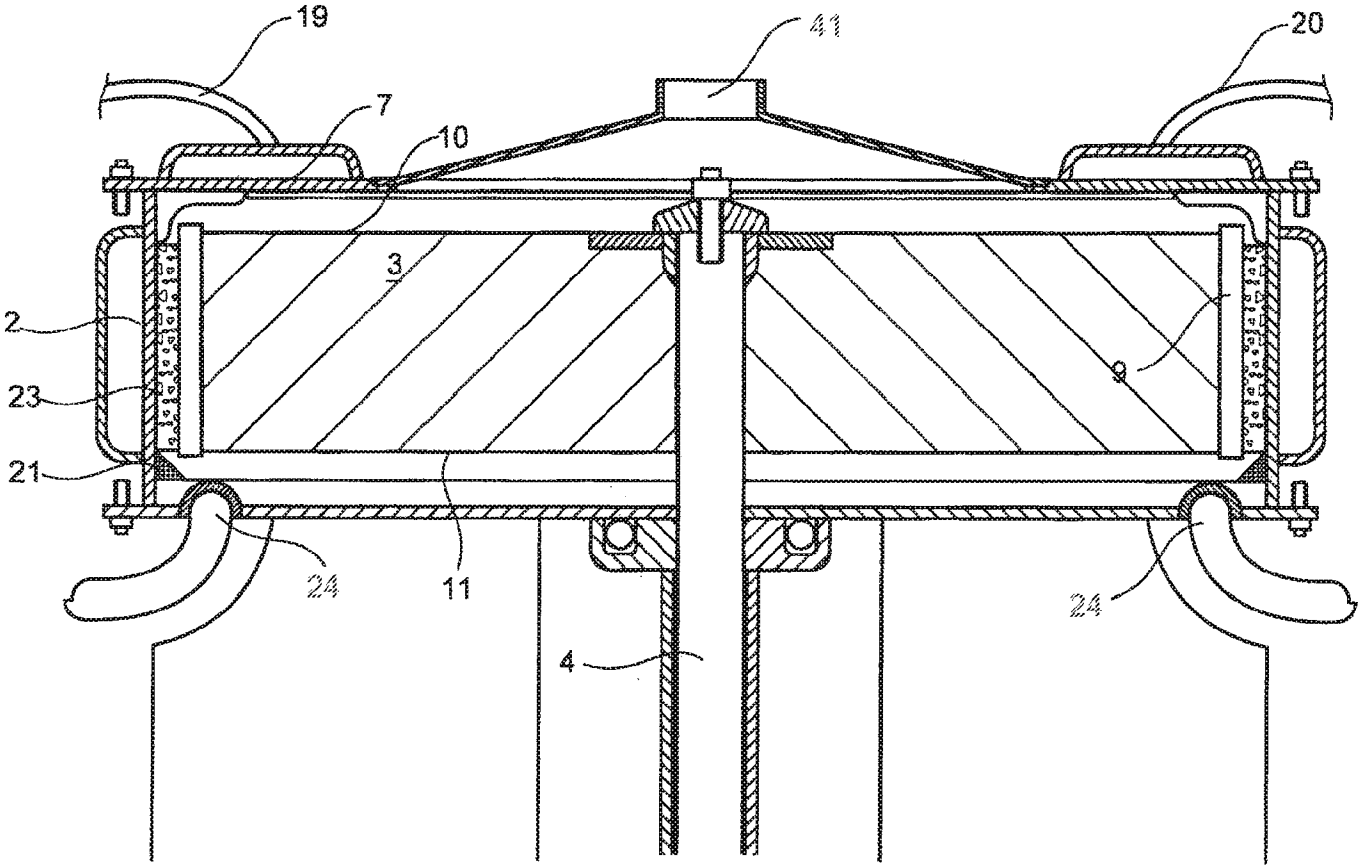
FIG. 2 is a side elevation of a cross section through the same machine as in FIG. 1.
Figure 3:
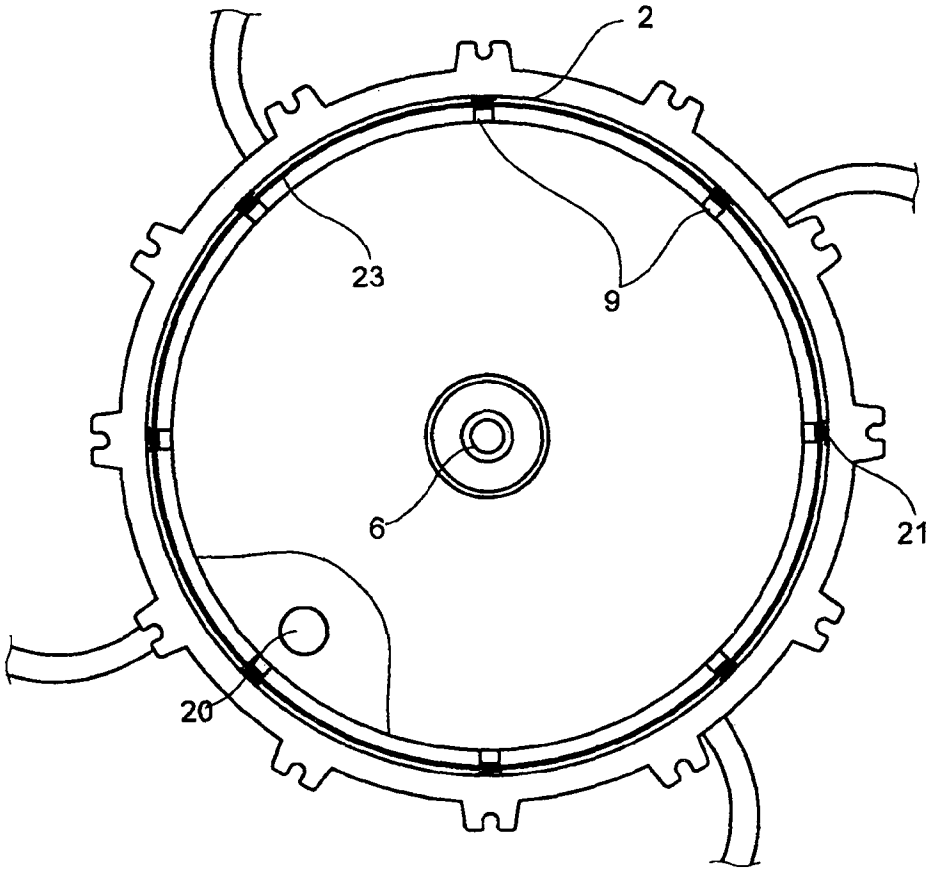
FIG. 3 is a view from above with the top removed of the machine according to the first embodiment.
Figure 4:
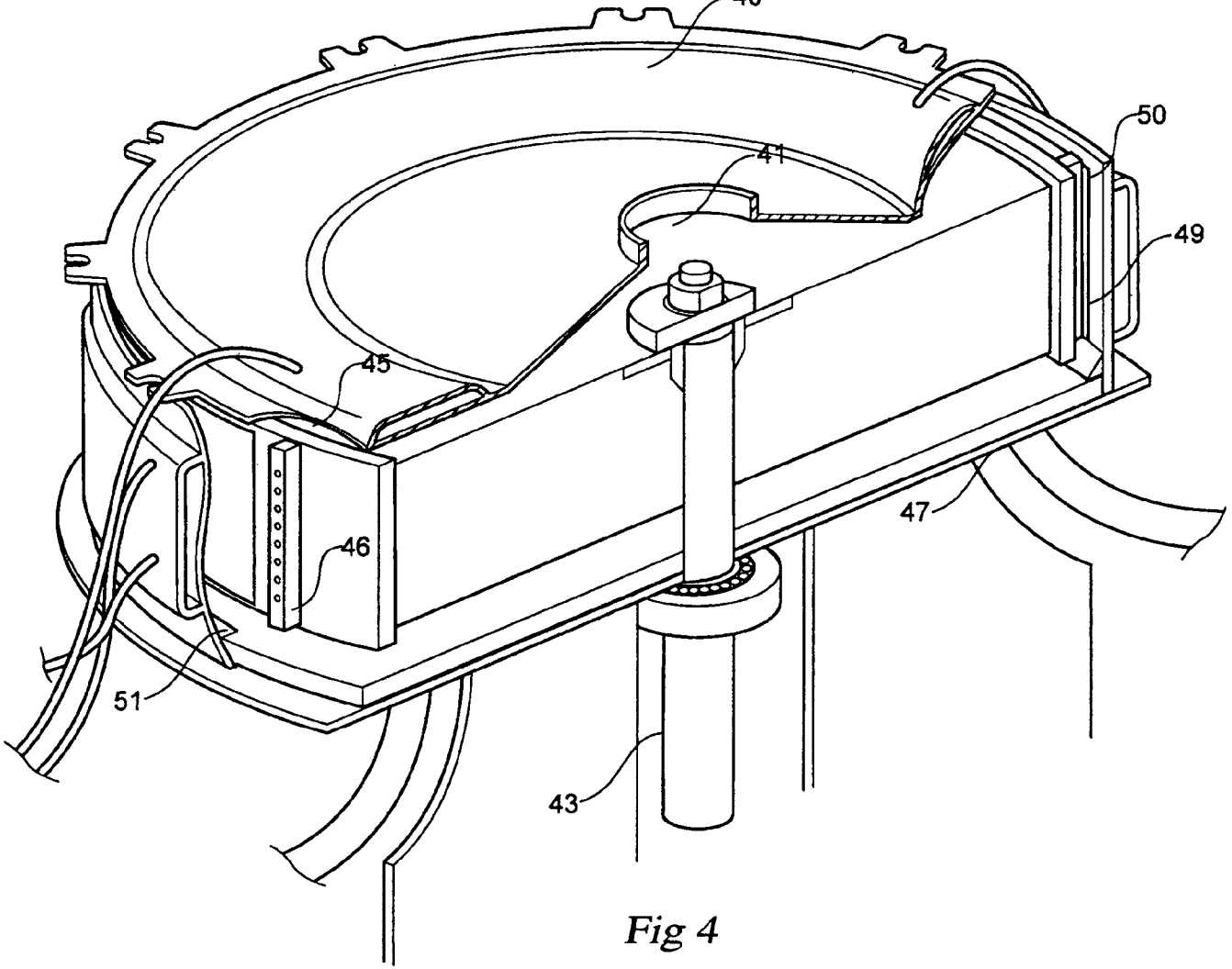
FIG. 4 is a perspective view with cross sections and part cut away of a machine according to a second embodiment.
Figure 5:
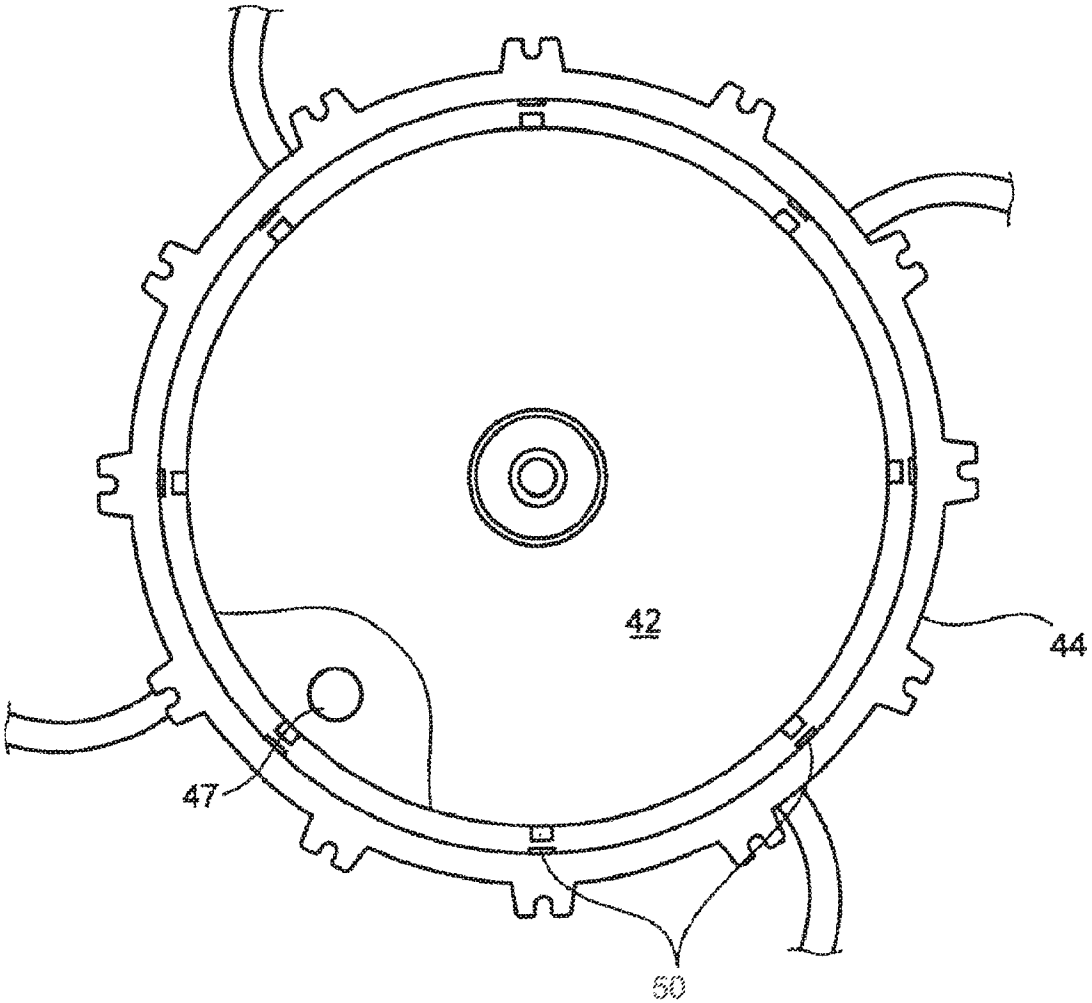
FIG. 5 is a view from above with a top of the machine removed. This machine being according to the second embodiment.
Figures 6, 7:
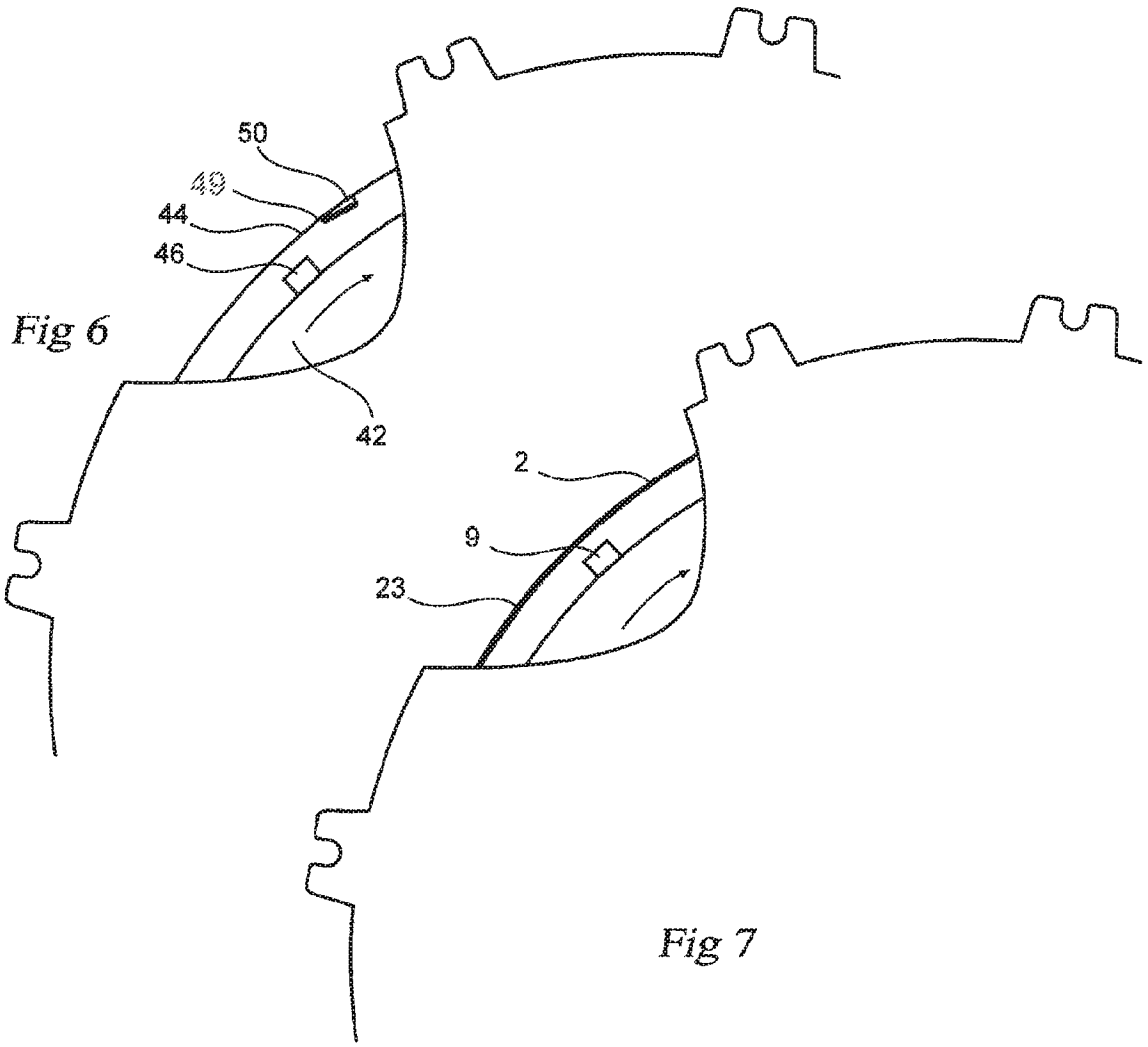
FIG. 6 is an enlarged view from above but also in part cut away and cross section illustrating an arrangement of a friction inducing segment relative to an outwardly extending blade according to the second embodiment.
FIG. 7 is cross section and part cut away when viewed from above of the arrangement of the wall and relative positioning of the outwardly extending blade according to the first embodiment, FIG. 8 (Prior Art) illustrates an example of the prior art where the blade is referenced in relation to a smooth inner wall.

Now referring in detail to the drawings and in particular to the drawings illustrating the first embodiment, there is chamber 1 which includes a cylindrical portion defined by all to which a rotor 3 was to rotate coaxially. The rotor 3 is supported by shaft 4 which is supported by bearings shown typically at 5. This is held in position by a locknut 6.

The rotor 3 is arranged to be rotatably driven by means attached to the shaft 4 which are not shown in the drawings but in this case include an electric motor connected through an appropriate set of pulleys and belts so as to drive the rotor of as an example 250 mm diameter at a rotational speed selected to be appropriate for the materials being treated but generally in the range of from 12000 rpm to 20000 rpm. It does appear that a speed of relevance is the relative speed generated at the circumference of the rotor from 200 km/hr to 1200 km/hr have been found to be useful.

The chamber 1 is further defined by having upper plate 7, and a further plate 8 which define between them and the cylindrical wall 2 the chamber 1.

The rotor 3 is of cylindrical outer dimensions and includes a plurality of outwardly extending blades 9 which are in each case of elongated rectangular dimensions extending from a top 10 of the rotor 3 to a bottom 11 of the rotor 3 in each case positioned so as to be separated around a diameter of the rotor 3 by a same distance apart.

These blades 9 are secured by a plurality of screws typically shown at 12. (These blades are secured in an alternative arrangement by fitting into interlocking slots)

The outer wall 2 has an outer jacket 13 so as to define a water cooling (or if appropriate heating) space 14 wherethrough water is directed by reason of conduits such as at 16 and 17 into and out of the jacket 14.

In like manner water cooling (or heating) is effected also for the plate 7 by reason of a further wall 18 and inlet and outlet conduits 19 and 20.

Material to be treated in this case erected through inlet 41 which is at the centre of the apparatus and coaxial with the axis of the shaft 4.

An outlet for material once treated is directed in this case by being collected through a hooded outlet 24 where there are a plurality of such hooded outlets located at spaced apart locations at a common diameter from the axis of the shaft 4 around the plate 8.

There is a choke 21 which is positioned beneath treatment gap 22 which is positioned so as to provide to some extent a restriction on passage of air and particulate materials being treated beyond the treatment space 22.

This choke 21 includes an upper face which is inclined to the vertical axial direction so as to provide some modest friction or choking of air flow and particles but to limit this to some extent.

The machine thus far described has for its purpose to treat and effect a disintegration of particles which are fed into its inlet and collected at its outlet with the area between an outer circumference area of the rotor and the inner wall of the cylinder therebetween.

The speed of the rotor 3 which is to say the rotational speed, the diameter of the rotor and the blades projecting from the rotor, the depth of the blades, and the extent of separation of these blades are chosen to effect an efficient disintegration of the materials to very small size.

An analysis of how the machine might work is suggested in that behind each blade as it follows the rotational path, air will be caused to be turbulent but by reason of the shape of the blades and the degree of separation, and from the discovery that there is a high degree of dehydration effected when this apparatus is used, it is considered that there are vortexes formed immediately behind each blade and it is the shock of entering into the highly vacuous centre of such a vortex or perhaps both entering and leaving such a vortex that it does appear to have both the high extent of efficient disintegration and dehydration.

Accordingly, in order to more effectively induce and maintain such vortexes especially when loaded with particles, it has been found that this can be achieved by increasing the friction inducing characteristic of the inner side of the cylindrical wall 2. This is achieved in one case by having randomly shaped and located hard particles adhering to the outer wall as is shown at 23.

This surface in this embodiment is provided fully around all of the inner surface of the cylindrical wall 2.

In one case, such a surface is comprised of silicon carbine particles held in a matrix.

It is an observation that in use the surface which is a friction inducing surface but which could be referred to as an abrasive surface does not provide an abrasive grinding effect to the material being treated.

The improvement in efficiency does appear to be caused by the friction inducing surface capturing and causing to further rotate the vortexes that are being induced behind the respective blades 9 and with a high degree of friction induction, the vortexes themselves and the load of particle materials that would be carried would be more intense.

In experiments conducted so far, when grinding materials using this process with this embodiment, there is very minimal abrasive effect being seen on the friction inducing surface 23 which again leads to the theory that it is not a directly engaging material with the materials to be treated but rather an indirect effect causing more positive and more effective vortexing.

In comparison to the use of a smooth wall as compared to the friction inducing surface or roughened wall, the effect has led to an improvement in efficiency in relation to many materials and also it has led to ability to reduce the size of particles resulting from use in the machine and in some cases these have been as small as 5 microns and smaller in size.

The extent of improvement in efficiency will vary with the treatment of different materials but in several cases has improved the efficiency by at least 100% which is to say that at least for the same rotational speed and power supply twice the amount of material can be treated in the time compared to previously where this friction inducing surface is not included.

There is a second embodiment which includes chamber 40, an inlet 41, a rotor 42 supported by a shaft 43, an outer wall 44 defining a cylindrical chamber 45, and a plurality of rectangularly and elongate blades 46 with hooded outlets 47. The difference here is that the friction inducing surface on the inside 44 is made up of separate segments which each have an outer surface 49 comprised of projecting randomly spaced apart and shaped particles held in a matrix and adhering thereby to an elongate wedge shaped member 50.

These members 50 are located around the circumference at spaced apart locations which are equally spaced apart distances equivalent to the separation between the respective blades 46.

Once again then, the effect of this is to induce and assist in maintaining vortexes behind the respective parallel blades 46 but they have the advantage that because they can be separately positioned as segments, they are firstly cheaper to manufacture and replace if damaged. The shape is slightly wedge shape with a leading edge closest to the inner surface of the wall 44 while a portion then projects outwardly from this in the downstream direction.

It is considered that by having the front edge to some extent protected, this will minimise potential lift away of any welded matrix or coating material holding the abrasive parts in place.

To some extent surprisingly, the inclusion of such separated segments also leads to an improvement equivalent to that experienced where the abrasive surface or the friction inducing surface is positioned fully around the inner circumference.

Once again then, other portions of the machine are included, including the choke 51.

Figure 8:
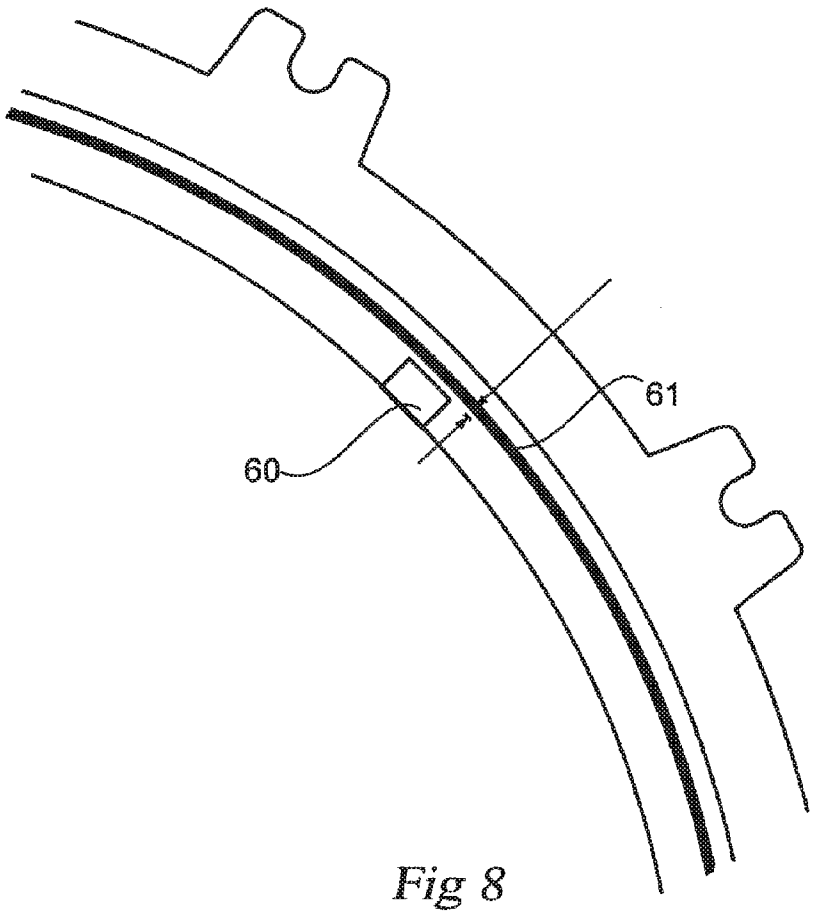

In FIG. 8, this is an illustration of the prior art in which the distance apart of an outer edge 60 from a smooth inner wall 61 in order to get a best disintegration effect was very small indeed and in this case is 3 mm but of course it is found that this can be increased now with the friction inducing or abrasive surface and still achieve fine particles getting down to sizes of 5 microns in many cases, and also having the advantage of being where appropriate dehydrated.

Example 1

1.5 mm diameter copper wire was chopped to 7 mm in length and used as the feed material into the machine without included friction inducing surface. A smooth walled water cooled cylinder was used as the outer wall of the grinding chamber with an inclined portion acting as a partial choke below the depth of the rotor. An overlap above the rotor was 3 mm. The diameter of the rotor was 200 mm. Three blades were secured to an outer perimeter of the rotor equally spaced apart around the diameter of the rotor and protruding from the rotor by 17 mm. The shape and size of each blade is the same and generally rectangular and each is bevelled at its top outermost edge and at its bottom outermost edge.

The top bevel dimension is down from the top 5 mm bevelled in from the edge 9 mm.

The bevel at the bottom is up from the bottom 12 mm and in from the outside edge 5 mm The copper wire feed material was fed in when the machine was rotating at 14,000 RPM which was a speed of rotation that had been previously found to be advantageous for this particular setup and material. This disintegrated copper material into small pieces under 200 micron with a mean average particle size of 90 micron. Out of 147 gms fed in one pass 20 gms remained in large balls 2 mm in diameter and these were left in the chamber at the end of the grinding session because there was not enough material in the machine once the feed stopped to keep the grinding process going.

It was then fed through a second time with the rotational speed increased to 19,000 RPM and the size dropped to 100 micron with a mean average size of 50 micron.

Example 2

Second example grinding copper wire with friction inducing surface material on the outer wall used in a second run.

1.5 mm diameter copper wire was chopped to 7 mm in length and used as the feed material into the grinding machine.

A smooth walled water cooled cylinder was used as the outer wall of the grinding chamber with a 45 degree cone predominantly below the depth of the rotor. An overlap above the rotor was 3 mm. The diameter of the rotor was 200 mm The depth of three blades protruding from the rotor being 17 mm and these blades are equally spaced apart, The shape of the blade is bevelled top and bottom with top bevel dimension down from the top 5 mm bevelled in from the edge 9 mm.

The bevel at the bottom is up from the bottom 12 mm and in from the outside edge 5 mm The copper wire feed material was fed in when the machine was doing 14,000 RPM this broke the copper wire up into small pieces under 200 micron with a mean average particle size of 90 micron. Out of 147 gms 20 gms remained in large balls 2 mm in diameter and these were left in the chamber at the end of the grinding session because there was not enough material in the machine once the feed stopped to keep the grinding process going.

Then sections of the outer wall of the cylinder were replaced by portions that had a friction inducing surface which in this case was were added to the outer cylinder. These ramps were the full depth of the wall of the cylinder matching the depth of the rotor which is 75 mm they finished just above the level of the top of a inclined surface choke. The width of these portions is 25 mm and the pitch of the surface of the material is 3.5 degrees flowing in the same direction as the rotor. This copper wire was put through a second time at 19,000 RPM. It reduced in size to top end of 60 micron with a mean average of 3 micron. The friction inducing surface resulted in a significant reduction in size of the treated material providing thereby an enhanced effect and increased efficiency.

Example 3

Zeolite

I repeated the same exercise with zeolite instead of copper as the feed material. The feed material was 3 mm randomly shaped zeolite gravel.

A smooth walled water cooled cylinder was used as the outer wall of the grinding chamber with an inclined surface choke predominantly below the depth of the rotor. The overlap above the rotor was 3 mm. The diameter of the rotor was 200 mm The depth of three blades protruding from the rotor being 17 mm and these blades were equally spaced apart, The shape of the blade was bevelled top and bottom.

The top bevel dimension is down from the top 5 mm bevelled in from the edge 9 mm.

The bevel at the bottom is up from the bottom 12 mm and in from the outside edge 5 mm The zeolite was run through at 19,000 RPM and the large size was 10 micron with a mean averages size of 5 micron.

Then repeated the test where sections of friction inducing surface were added to the outer cylinder. These sections which were each randomly shaped portions projecting into the substantially cylindrical space and were the full depth of the wall of the cylinder matching the depth of the rotor which is 75 mm they finished just above the level of the top of the inclined surface choke. The width of these sections is 25 mm and a taper of each of the sections was 3.5 degrees flowing in the same direction as the rotor. This Zeolite was put through. The feed material was 3 mm zeolite and the rotor speed was 19,000 RPM the top size was 7 micron and the mean average was 1.5 micron.

This again disclosed the advantage of the addition friction inducing material.

The invention claimed is:

1. A particle treatment method for reducing particle size including the steps of:

(i) introducing particles to be treated into an apparatus where there is a chamber with a generally cylindrical portion and a rapidly rotating rotor coaxially positioned within the generally cylindrical portion defining a substantially annular space between the rotating rotor and the generally cylindrical portion, two or more blades spaced an equal distance apart around the circumference of the rotor and each extending from the rotor and defining a separation gap between an inner wall of the cylindrical portion and an outer edge or face of each of the respective blades, there being one or more vortex supporting and defining spaces between the respective blades, and at least some of the inner wall of the cylindrical portion having a friction inducing surface including randomly shaped portions projecting into at least some of the vortex supporting and defining spaces at spaced apart locations around a periphery of the generally cylindrical chamber; and (ii) collecting the resultant treated particles.

2. A particle treatment method as in claim 1 further comprised in that the rotation speed of the rotor during the treatment is within the range of from 12,000 to 20,000 revolutions per minute on a 250 mm rotor.

3. An apparatus comprising a chamber with a generally cylindrical portion and a rotating rotor coaxially positioned within the generally cylindrical portion, two or more blades spaced an equal distance apart around the circumference of the rotor and each extending radially from the rotor and defining a separation gap between an inner wall of the generally cylindrical portion and an outer edge of the respective blade, and there being one or more vortex supporting and defining space or spaces between the respective blades, and at least some of the inner wall of the generally cylindrical portion having a friction inducing surface including randomly shaped portions projecting into at least some of the vortex supporting and defining spaces at spaced apart locations around a periphery of the generally cylindrical chamber, an inlet for particles to be treated in the chamber and an outlet for particles treated spaced apart from the inlet.

4. A particle treatment apparatus as in claim 3 further comprised in that the apparatus is adapted to enable the rotation speed of the rotor during the treatment to be within the range of from 12,000 to 20,000 revolutions per minute on a 250 mm rotor.

5. A particle treatment apparatus as claimed in claim 3 including a choke for restricting passage of air into the chamber.

6. A particle treatment apparatus as claimed in claim 3 including a jacket for heating or cooling the chamber.

* * * * *